US010408471B1

(12) United States Patent
Lanouette

(10) Patent No.: US 10,408,471 B1
(45) Date of Patent: Sep. 10, 2019

(54) WIRELESS CARBON MONOXIDE FURNACE SHUTOFF SYSTEM

(71) Applicant: Lionel Lanouette, Raymond, NH (US)

(72) Inventor: Lionel Lanouette, Raymond, NH (US)

( * ) Notice: Subject to any disclaimer, the term of this patent is extended or adjusted under 35 U.S.C. 154(b) by 411 days.

(21) Appl. No.: 15/391,937

(22) Filed: Dec. 28, 2016

(51) Int. Cl.
*G08B 17/10* (2006.01)
*F24D 19/10* (2006.01)
*F23N 5/24* (2006.01)

(52) U.S. Cl.
CPC ..... *F24D 19/1084* (2013.01); *F23N 5/242* (2013.01); *F23N 2041/02* (2013.01)

(58) Field of Classification Search
CPC ..... G08B 21/14; G08B 21/12; G08B 17/10; G08B 29/00; G08B 17/00; G05B 19/0428; A62C 5/14; A62C 2/24; A62C 2/12
USPC ..... 340/632, 628, 629, 630, 579
See application file for complete search history.

(56) References Cited

U.S. PATENT DOCUMENTS 5,838,243 A * 11/1998 Gallo ..... F23N 5/242 340/632
6,339,379 B1 * 1/2002 Argus ..... F23N 5/003 340/539.1
6,484,951 B1 * 11/2002 Mueller ..... G05D 23/1902 126/116 A
6,989,757 B2 * 1/2006 Geoffrey J. ..... A62B 9/006 340/506
7,033,165 B1 4/2006 Brown
7,579,956 B2 * 8/2009 Chapman, Jr. ..... F24F 11/0001 340/632
D653,138 S 1/2012 Taylor et al.
8,890,701 B2 11/2014 Mahajan
8,893,707 B2 11/2014 Jamieson
2004/0252028 A1 * 12/2004 Odd, Jr. ..... G08B 21/182 340/584
2008/0182506 A1 * 7/2008 Jackson ..... F24F 11/30 454/354
2012/0251963 A1 * 10/2012 Barker ..... F23N 5/003 432/1
2013/0327141 A1 12/2013 Floyd, Jr.

FOREIGN PATENT DOCUMENTS

EP 2525147 A2 11/2012

* cited by examiner

*Primary Examiner* — Toan N Pham

(57) ABSTRACT

The wireless carbon monoxide furnace shutoff system is a safety device that monitors the interior of a space for unsafe concentrations of carbon monoxide (CO) and carbon dioxide (CO2). The wireless carbon monoxide furnace shutoff system will shut off the furnace should an unsafe concentration of either CO or CO2 be detected within the interior space. The wireless carbon monoxide furnace shutoff system comprises a remote module and a furnace module. The remote module and the furnace module are connected with a wireless communication link. The remote module monitors the concentration of CO and the concentration of CO2 within the interior space. The remote module sends a plurality of messages to the furnace module that enables and disables the operation of the furnace based on the concentration of CO and the concentration of CO2 measured within the interior space.

12 Claims, 5 Drawing Sheets

WIRELESS CARBON MONOXIDE FURNACE SHUTOFF SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of combustion and controlling combustion, more specifically, a safety device configured for use with a furnace.

SUMMARY OF INVENTION

The wireless carbon monoxide furnace shutoff system is a control system adapted for use with a domestic furnace. Specifically, the wireless carbon monoxide furnace shutoff system is a safety device that monitors the interior of a domestic space for unsafe concentrations of carbon monoxide (CO) and carbon dioxide (CO2). The wireless carbon monoxide furnace shutoff system will shut off the furnace should an unsafe concentration of either CO or CO2 be detected within the domestic interior space. The wireless carbon monoxide furnace shutoff system comprises a remote module and a furnace module. The remote module and the furnace module are connected with a wireless communication link. The remote module monitors the concentration of CO and the concentration of CO2 within domestic interior space. The remote module sends a plurality of messages to the furnace module that enables and disables the operation of the furnace based on the concentration of CO and the concentration of CO2 measured within the domestic interior space.

It shall be noted that the wireless carbon monoxide furnace shutoff system can be adapted for use with other appliances, and not just solely a furnace.

These together with additional objects, features and advantages of the wireless carbon monoxide furnace shutoff system will be readily apparent to those of ordinary skill in the art upon reading the following detailed description of the presently preferred, but nonetheless illustrative, embodiments when taken in conjunction with the accompanying drawings.

In this respect, before explaining the current embodiments of the wireless carbon monoxide furnace shutoff system in detail, it is to be understood that the wireless carbon monoxide furnace shutoff system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the wireless carbon monoxide furnace shutoff system.

It is therefore important that the claims be regarded as including such equivalent construction insofar as they do not depart from the spirit and scope of the wireless carbon monoxide furnace shutoff system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
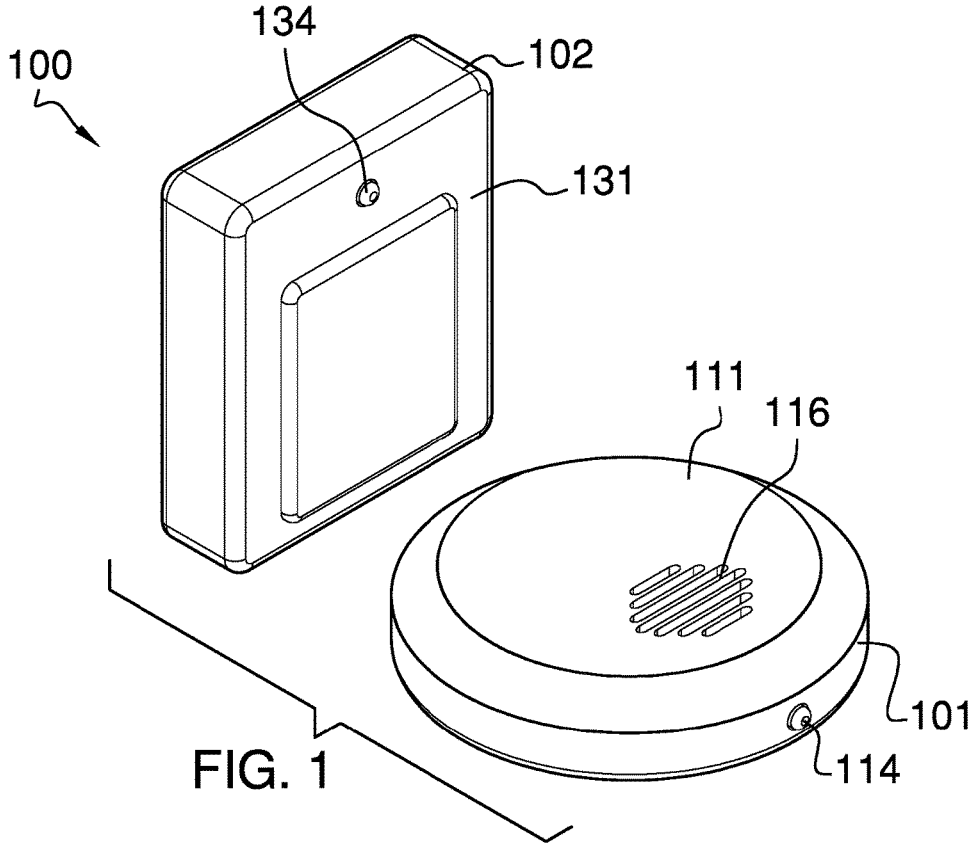
FIG. 1 is a perspective view of an embodiment of the disclosure.
Figure 2:
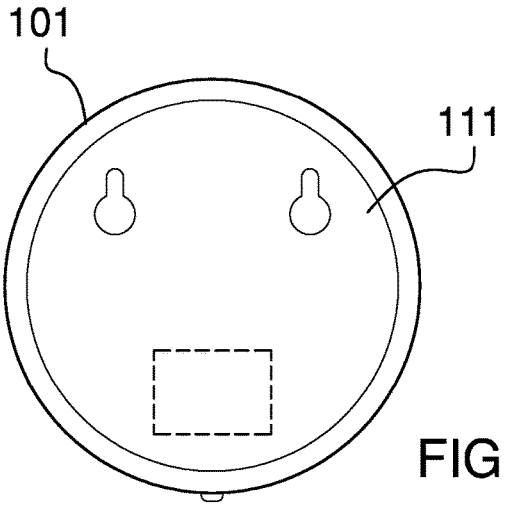
FIG. 2 is a detail view of an embodiment of the disclosure.
Figure 3:
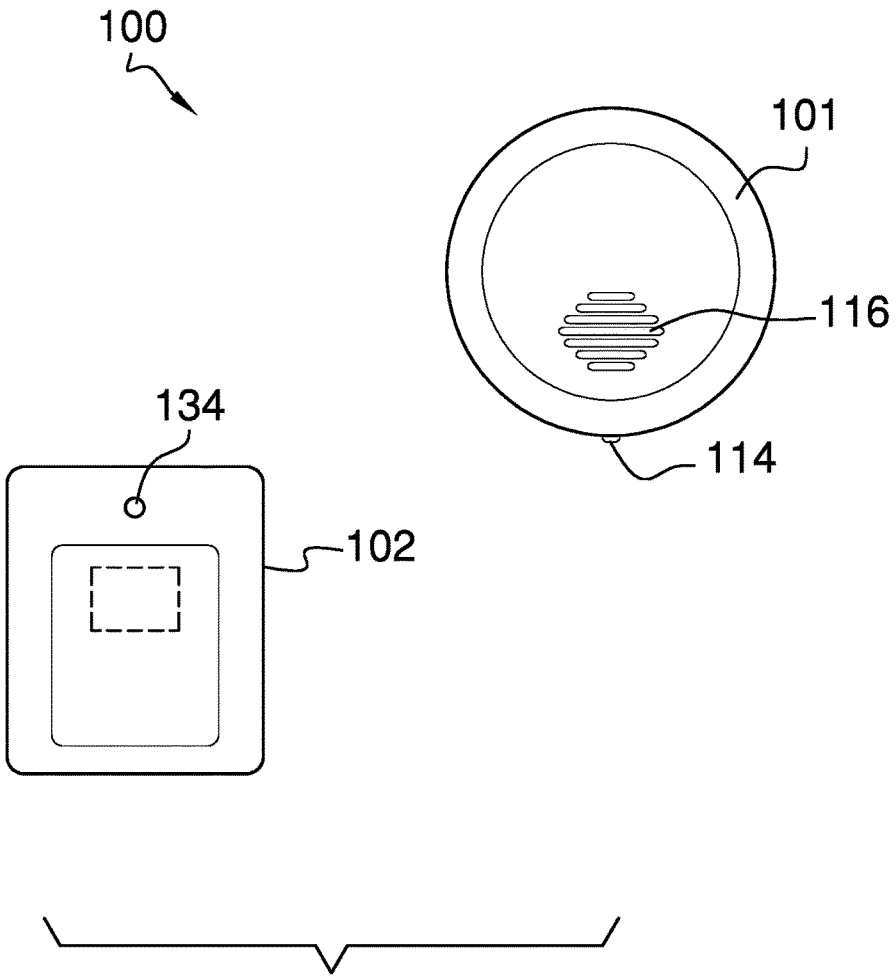
FIG. 3 is a front view of an embodiment of the disclosure.
Figure 4:
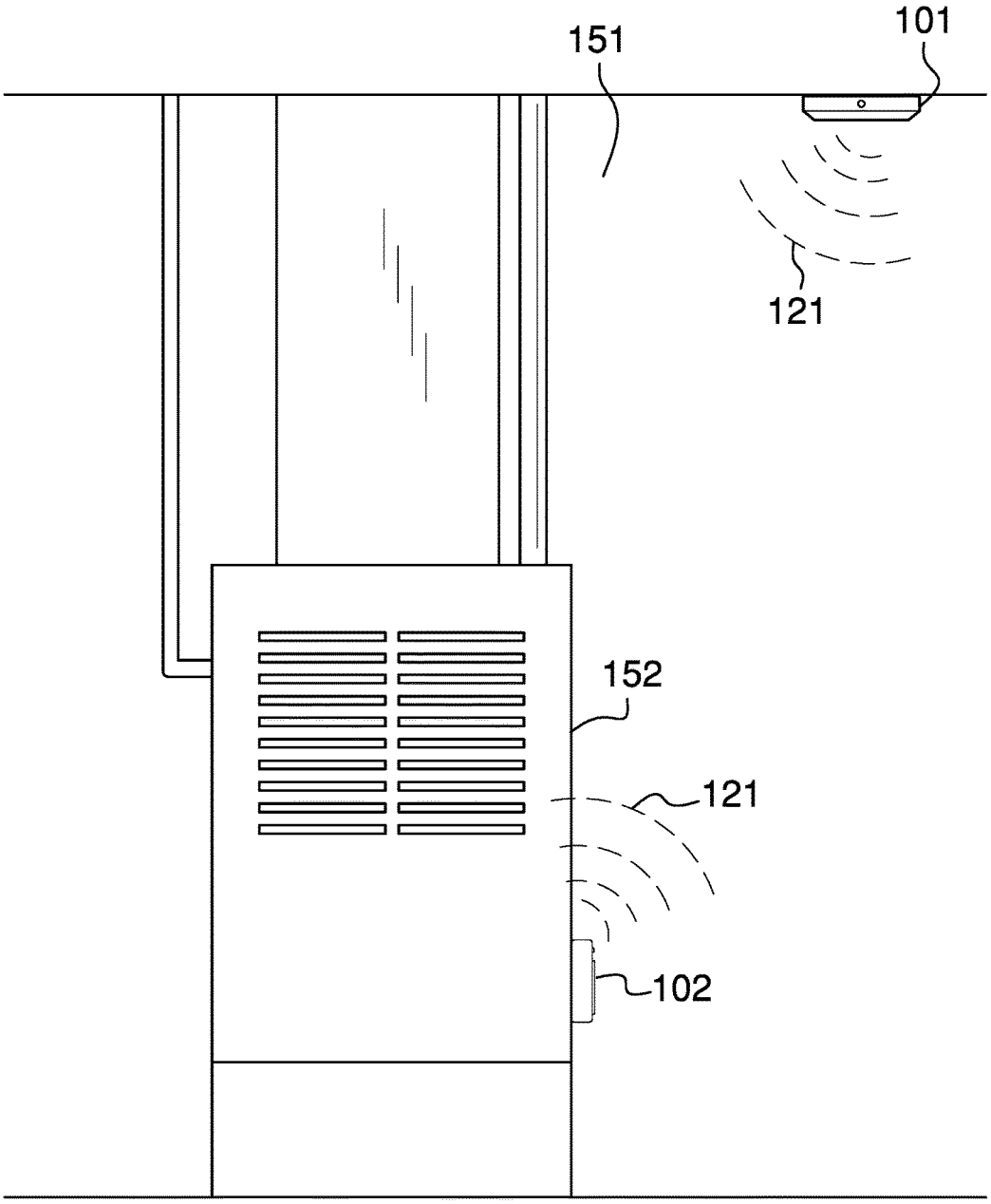
FIG. 4 is an in use view of an embodiment of the disclosure.
Figure 5:
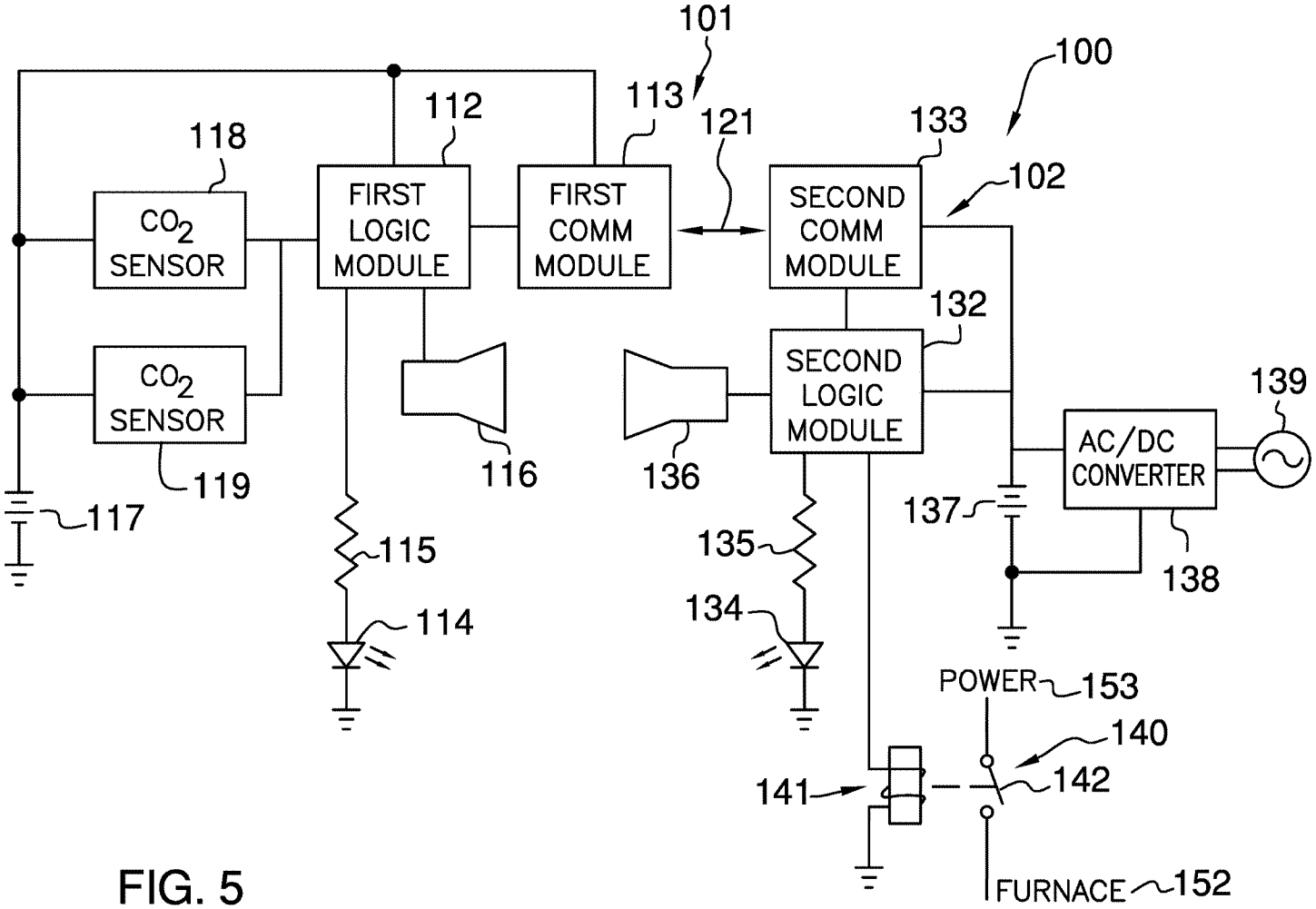
FIG. 5 is a schematic view of an embodiment of the disclosure.
Figure 6:
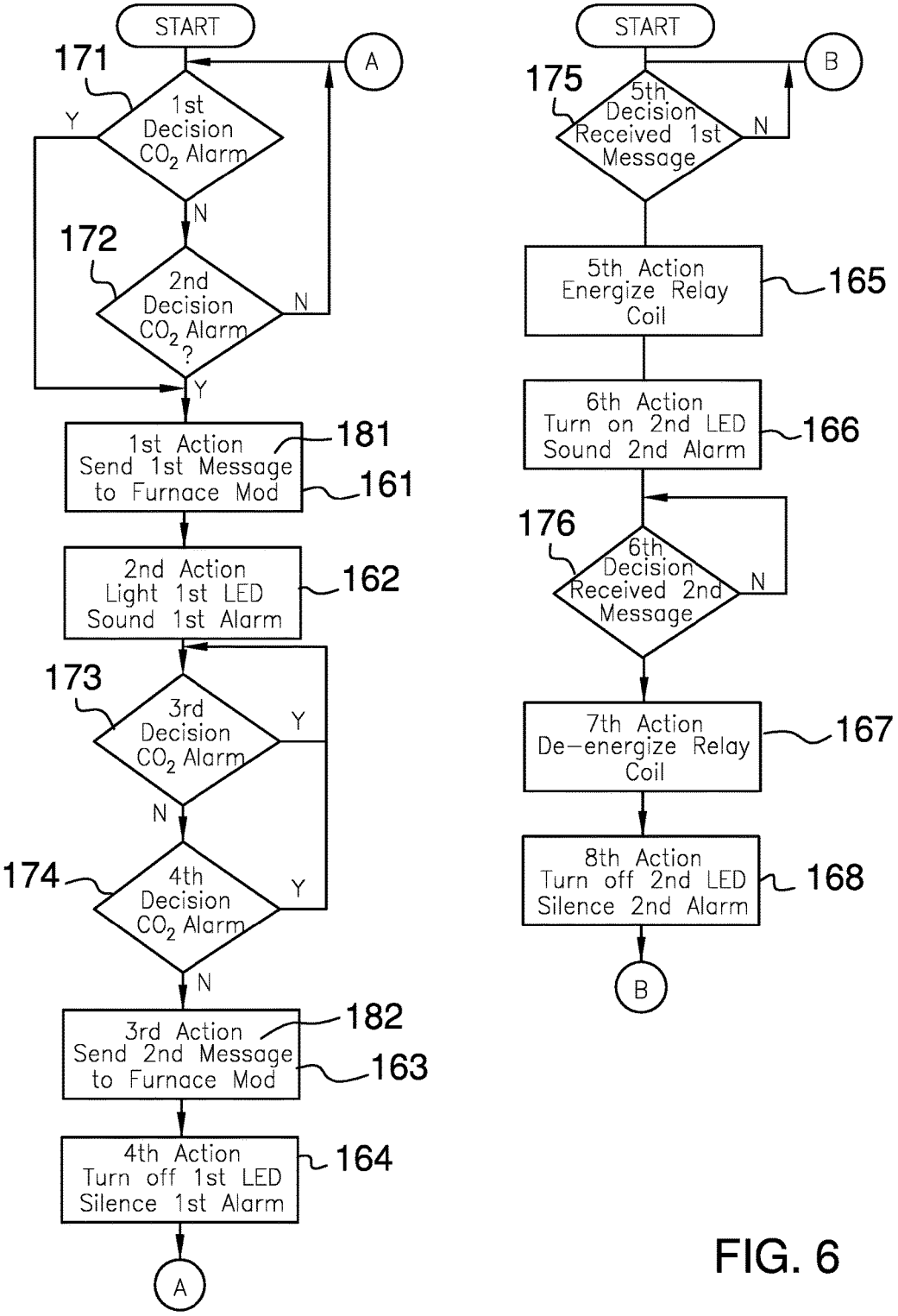
FIG. 6 is a flowchart of an embodiment of the disclosure.

Detailed reference will now be made to one or more potential embodiments of the disclosure, which are illustrated in FIGS. 1 through 6.

The wireless carbon monoxide furnace shutoff system 100 (hereinafter invention) is a control system adapted for use with a furnace 152. The furnace 152 is a commercially available and externally provided domestic furnace 152 that is used to heat a domestic interior space 151. The domestic interior space 151 is a temperature-controlled space that is formed in the interior of a domestic structure. Specifically, the invention 100 is a safety device that monitors the domestic interior space 151 for unsafe concentrations of carbon monoxide (CO) and carbon dioxide (CO2). In this disclosure, the detection of an unsafe concentration of either carbon monoxide (CO) or carbon dioxide (CO2) (or both) is referred to as an alarm condition. The invention 100 will disable the furnace 152 should an alarm condition be detected within the domestic interior space 151. The invention 100 comprises a remote module 101 and a furnace module 102. The remote module 101 and the furnace module 102 are connected with a wireless communication link 121. The remote module 101 monitors the concentration of CO and the concentration of CO2 within domestic interior space 151. The remote module 101 sends a plurality of messages to the furnace module 102 that enables and disables the operation of the furnace 152 based on the concentration of CO and the concentration of CO2 measured within the domestic interior space 151.

The remote module 101 is an electrical device that is mounted within the domestic interior space 151 that is heated by the furnace module 102. The remote module 101 comprises a first housing 111, a first logic module 112, a first communication module 113, a first diode 114, a first limit resistor 115, a first speaker 116, a first battery 117, a CO2 sensor 118, and a CO sensor 119. The first logic module 112, the first communication module 113, the first diode 114, the first limit resistor 115, the first speaker 116, the first battery 117, the CO2 sensor 118, and the CO sensor 119 are electrically interconnected. The first logic module 112, the first communication module 113, the first diode 114, the first limit resistor 115, the first speaker 116, the first battery 117, the CO2 sensor 118, and the CO sensor 119 are contained within the first housing 111.

The first housing 111 is a rigid container within which the electronic circuitry of the remote module 101 is contained. The first housing 111 is designed such that both the CO2 sensor 118 and the CO sensor 119 have access to the airspace of the domestic interior space 151. As shown most clearly in FIG. 4, the first housing 111 is mounted within the domestic interior space 151.

The first logic module 112 is an electrical device that regulates the behavior and operation of the remote module 101. The first communication module 113 is a commercially available electronic device that transmits the plurality of messages to the furnace module 102.

The first diode 114 is a commercially available LED. The first diode 114 is controlled by the first logic module 112 and is illuminated to indicate an alarm condition. The first limit resistor 115 is a commercially available resistor. The first limit resistor 115 limits current flow through the first diode 114.

The first speaker 116 is a transducer that converts electrical signals to an audible sound. In the first potential embodiment of the disclosure, the first speaker 116 is a commercially available buzzer. The first speaker 116 is controlled by the first logic module 112 and is activated to audibly indicate an alarm condition.

The first battery 117 is a commercially available disposable chemical device that is used to provide electrical power to the remote module 101.

The CO2 sensor 118 is a commercially available sensor that measures the concentration 5 of carbon dioxide in the domestic interior space 151. The CO2 sensor 118 is monitored via the first logic module 112. The CO sensor 119 is a commercially available sensor that measures the concentration of carbon monoxide in the domestic interior space 151. The CO sensor 119 is monitored via the first logic module 112.

The furnace module 102 is an electrical device that integrates into the furnace 152. The furnace module 102 enables and disables the operation of the furnace 152. The furnace module 102 comprises a second housing 131, a second logic module 132, a second communication module 133, a second diode 134, a second limit resistor 135, a second speaker 136, a second battery 137, an AC/DC converter 138, an external power source 139, and a relay 140. The second logic module 132, the second communication module 133, the second diode 134, the second limit resistor 135, the second speaker 136, the second battery 137, an AC/DC converter 138, an external power source 139, and the relay 140 are electrically interconnected. The second logic module 132, the second communication module 133, the second diode 134, the second limit resistor 135, the second speaker 136, the second battery 137, an AC/DC converter 138, an external power source 139, and the relay 140 are contained within the second housing 131.

The second housing 131 is a rigid container within which the electronic circuitry of the furnace module 102 is contained. As shown most clearly in FIG. 4, the second housing 131 is mounted on or within the furnace 152.

The second logic module 132 is an electrical device that regulates the behavior and operation of the furnace module 102. The second communication module 133 is a commercially available electronic device that receives the plurality of messages from the first communication module 113 of the remote module 101.

The second diode 134 is a commercially available LED. The second diode 134 is controlled by the second logic module 132 and is illuminated to indicate an alarm condition. The second limit resistor 135 is a commercially available resistor. The second limit resistor 135 limits current flow through the second diode 134.

The second speaker 136 is a transducer that converts electrical signals to an audible sound. In the first potential embodiment of the disclosure, the second speaker 136 is a commercially available buzzer. The second speaker 136 is controlled by the second logic module 132 and is activated to audibly indicate an alarm condition.

The second battery 137 is a commercially available chemical device that is used to provide electrical power to the furnace module 102. The AC/DC converter 138 is a commercially available device that receives AC electricity from an external power source 139 and converts the AC electricity into DC electricity suitable for use in recharging the second battery 137. The external power source 139 is an externally provided source of AC electricity. In the first potential embodiment of the disclosure, it is presumed that the external power source 139 is the national electric grid.

In the first potential embodiment of the disclosure, the second battery 137 is a commercially available rechargeable battery. The chemical energy stored within the second battery 137 is renewed and restored through use of the AC/DC converter 138. The AC/DC converter 138 is an electrical circuit that reverses the polarity of the second battery 137 and provides the energy necessary to reverse the chemical processes that the second battery 137 initially used to generate the electrical energy. This reversal of the chemical process creates a chemical potential energy that will later be used to generate electricity.

The relay 140 is a readily and commercially available relay 140. The relay 140 is further defined with a coil 141 and a switch 142. The use of relays is well known and documented in the electrical arts. The coil 141 is an electromagnetic coil that generates a magnetic field that is used to open and close the switch 142 of the relay 140. The closing of the switch 142 will disable the furnace 152. As shown most clearly in FIG. 5, the switch 142 is installed within the furnace 152 such that the switch 142 will disconnect the power to the furnace 152 in order to disable the furnace 152 in an alarm condition. In the first potential embodiment of the disclosure, as shown most clearly in FIG. 5, the switch 142 is placed in series between the electrical power supply 153 for the furnace 152 and the furnace 152.

In the first potential embodiment of the disclosure, the first communication module 113 and the second communication module 133 communicates over the wireless communication link 121 using Bluetooth protocols. The first speaker 116 and the second speaker 136 are both readily and commercially available buzzers. The first logic module 112 and the second logic module 132 is assembled from discrete logic elements.

In a second potential embodiment of the disclosure, the first logic module 112 and the second logic module 132 are programmable electronic devices.

Methods to design and assemble the circuitry described in the remote module 101 are well known and documented in the electrical arts. Methods to design and assemble the circuitry described in the furnace module 102 are well known and documented in the electrical arts.

The operation of the invention 100 is now described.

The first logic module 112 makes a first decision 171 to determine whether the CO2 sensor 118 has detected a high concentration of carbon dioxide. If the first logic module 112 does not detect a high concentration of carbon dioxide the first logic module 112 proceeds to the second decision 172. If the first logic module 112 does detect a high concentration of carbon dioxide the first logic module 112 proceeds to the first action 161.

The first logic module 112 makes a second decision 172 to determine whether the CO sensor 119 has detected a high concentration of carbon monoxide. If the first logic module 112 does not detect a high concentration of carbon monoxide the first logic module 112 loops back to the first decision 171. If the first logic module 112 does detect a high concentration of carbon monoxide the first logic module 112 proceeds to the first action 161.

The first logic module 112 takes a first action 161 of sending the first message 181 from the first communication module 113 to the second communication module 133. The first logic module 112 sends the first message 181 through the first communication module 113 to the second communication module 133 of the second logic module 132. The first message 181 is a message that is sent from the remote module 101 to the furnace module 102 indicating that an alarm condition has been detected. The first logic module 112 then proceeds to the second action 162.

The first logic module 112 takes a second action 162 of illuminating the first diode 114 and sounding the first speaker 116 to announce the alarm condition.

The first logic module 112 then makes a third decision 173 to determine whether the CO2 sensor 118 continues to detect a high concentration of carbon dioxide. If the first logic module 112 does detect a high concentration of carbon dioxide the first logic module 112 loops back to the third decision 173. If the first logic module 112 does not detect a high concentration of carbon dioxide the first logic module 112 proceeds to the fourth decision 174.

The first logic module 112 makes a fourth decision 174 to determine whether the CO sensor 119 continues to detect a high concentration of carbon monoxide. If the first logic module detects continues to detect a high concentration of carbon monoxide then the first logic module 112 loops back to the third decision 173. If the first logic module 112 does not detect a high concentration of carbon monoxide the first logic module 112 proceeds to the third action 163.

The first logic module 112 takes a third action 163 of sending the second message 182 from the first communication module 113 to the second communication module 133. The first logic module 112 sends the second message 182 through the first communication module 113 to the second communication module 133 of the second logic module 132. The second message 182 is a message that is sent from the remote module 101 to the furnace module 102 indicating that the alarm condition is no longer being detected.

The first logic module 112 then takes a fourth action 164 of extinguishing the first diode 114 and silencing the first speaker 116.

The second logic module 132 makes a fifth decision 175 to determine whether the second communication module 133 has received the first message 181. If the second logic module 132 determines that the first message 181 has been received, then the second logic module 132 takes the fifth action 165. If the second logic module 132 determines that the first message 181 has not been received, then the second logic module 132 loops back to the fifth decision 175.

The second logic module 132 takes a fifth action 165 energizing the relay 140 coil 141 in order to disable the furnace 152. The second logic module 132 then takes a sixth action 166 illuminating the second diode 134 and sounding the second speaker 136 to announce the alarm condition.

The second logic module 132 makes a sixth decision 176 to determine whether the second communication module 133 has received the second message 182. If the second logic module 132 determines that the second message 182 has been received, then the second logic module 132 takes the seventh action 167. If the second logic module 132 determines that the second message 182 has not been received, then the second logic module 132 loops back to the sixth decision 176.

Optionally, the second logic module 132 takes a seventh action 167 of de-energizing the relay 140 coil 141 in order to enable the furnace 152. The second logic module 132 then takes an eighth action 168 of extinguishing the second diode 134 and silencing the second speaker 136.

The following definitions were used in this disclosure:

AC: As used in this disclosure, AC is an acronym for alternating current.

AC/DC Converter: As used in this disclosure, an AC/DC converter is an electrical device that converts an AC voltage into a DC voltage. Method to design and build AC/DC converters are well known in the electrical arts.

Battery: As used in this disclosure, a battery is a container consisting of one or more cells, in which chemical energy is converted into electricity and used as a source of power.

Buzzer: As used in this disclosure, a buzzer is two lead electrical device that generates an audible sound when voltage is applied to the two leads.

CO: As used in this disclosure, CO is the chemical designation, and is used as an acronym, for carbon monoxide.

CO2: As used in this disclosure, CO2 is the chemical designation, and is used as an acronym, for carbon dioxide.

DC: As used in this disclosure, DC is an acronym for direct current.

Diode: As used in this disclosure, a diode is a two terminal semiconductor device that allows current flow in only one direction. The two terminals are called the anode and the cathode. Electric current is allowed to pass from the anode to the cathode.

Domestic: As used in this disclosure, the term domestic refers to an item or object that is commonly found within a household.

Furnace: A used in this disclosure, a furnace is an enclosure within which a fueled combustion reaction occurs for the purpose of generating heat.

LED: As used in this disclosure, an LED is an acronym for a light emitting diode. A light emitting diode is a diode that is also a light source. Because of close operational correspondence of the function of the cathode and anode of an organic LEDs and the cathode and anode of a semiconductor LED, organic LEDs are included in this definition.

Logic Module: As used in this disclosure, a logic module is an electrical device that is programmable and that accepts digital and analog inputs, processes the digital and analog inputs according to previously stored instruction and provides the results of these instructions as digital or analog outputs.

National Electric Grid: As used in this disclosure, the national electric grid is a synchronized and highly interconnected electrical network that distributes energy in the form of electric power from a plurality of generating stations to consumers of electricity.

Relay: As used in this disclosure, a relay is an automatic electromagnetic or electromechanical device that reacts to changes in voltage or current by opening or closing a switch in an electric circuit. Relays further defined with a coil and a switch. Applying a voltage to the coil, usually referred to as energizing the coil, will cause the coil to change the position of the switch. Note: Though transistors can be configured to perform switching functions, transistors used for switching functions are handled separately in this disclosure and are explicitly excluded from this definition.

Sensor: As used in this disclosure, a sensor is a device that receives and responds in a predetermined way to a signal or stimulus. As further used in this disclosure, a threshold sensor is a sensor that generates a signal that indicates whether the signal or stimulus is above or below a given threshold for the signal or stimulus.

Speaker: As used in this disclosure, a speaker is an electrical device that converts an electrical signal into an audible sound.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A safety device configured for use with a furnace comprising:

a remote module and a furnace module;

wherein the remote module and the furnace module are connected with a wireless communication link;

the safety device is a control system adapted for use with said furnace;

wherein the furnace is used to heat an interior space;

wherein the interior space is a temperature controlled space that is formed in the interior of a structure;

wherein the furnace module is a safety device that monitors the interior space for unsafe concentrations of carbon monoxide (CO) and carbon dioxide (CO2);

wherein a detection of an unsafe concentration of either (CO) or (CO2) or both is referred to as an alarm condition;

wherein the safety device will disable the furnace should the alarm condition be detected within the interior space;

wherein the remote module monitors the concentration of CO and the concentration of CO2 within the interior space;

wherein the remote module sends a plurality of messages to the furnace module that disables an operation of the furnace;

wherein the remote module is an electrical device that is mounted within the interior space that is heated by the furnace module;

wherein the remote module comprises a first housing, a first logic module, a first communication module, a first diode, a first limit resistor, a first speaker, a first battery, a CO2 sensor, and a CO sensor;

wherein the first logic module, the first communication module, the first diode, the first limit resistor, the first speaker, the first battery, the CO2 sensor, and the CO sensor are electrically interconnected;

wherein the first logic module, the first communication module, the first diode, the first limit resistor, the first speaker, the first battery, the CO2 sensor, and the CO sensor are contained within the first housing;

wherein the first housing is a rigid container;

wherein the first housing is designed such that both the CO2 sensor and the CO sensor have access to an airspace of the interior space;

wherein the first logic module is an electrical device that regulates a behavior and operation of the remote module;

wherein the first communication module is an electronic device that transmits the plurality of messages to the furnace module;

wherein the first diode is an LED;

wherein the first diode is controlled by the first logic module;

wherein the first diode is illuminated to indicate the alarm condition;

wherein the first limit resistor limits current flow through the first diode;

wherein the first speaker is a transducer that converts electrical signals to an audible sound;

wherein the first speaker is controlled by the first logic module and is activated to audibly indicate the alarm condition;

wherein the CO2 sensor is a sensor that measures the concentration of carbon dioxide in the interior space;

wherein the CO2 sensor is monitored by the first logic module;

wherein the CO sensor is a commercially available sensor that measures the concentration of carbon monoxide in the interior space;

wherein the CO sensor is monitored by the first logic module;

wherein the furnace module is an electrical device that integrates into the furnace;

wherein the furnace module disables the operation of the furnace;

wherein the furnace module comprises a second housing, a second logic module, a second communication module, a second diode, a second limit resistor, a second speaker, a second battery, an AC/DC converter, an external power source, and a relay;

wherein the second logic module, the second communication module, the second diode, the second limit resistor, the second speaker, the second battery, an AC/DC converter, an external power source, and the relay are electrically interconnected;

wherein the second logic module, the second communication module, the second diode, the second limit resistor, the second speaker, the second battery, an AC/DC converter, an external power source, and the relay are contained within the second housing.

2. The safety device configured for use with the furnace according to claim 1 wherein the second housing is a rigid container;

wherein the second housing is mounted in a location selected from the group consisting of on the furnace or within the furnace.

3. The safety device configured for use with the furnace according to claim 2 wherein the second logic module is an electrical device that regulates the behavior and operation of the furnace module;

wherein the second communication module is an electronic device that receives the plurality of messages from the first communication module of the remote module.

4. The safety device configured for use with the furnace according to claim 3 wherein the second diode is an LED;

wherein the second diode is controlled by the second logic module;

wherein the second diode is illuminated to indicate an alarm condition;

wherein the second limit resistor limits current flow through the second diode;

wherein the second speaker is a transducer that converts electrical signals to an audible sound;

wherein the second speaker is controlled by the second logic module and is activated to audibly indicate an alarm condition.

5. The safety device configured for use with the furnace according to claim 4 wherein the second battery is a chemical device;

wherein the AC/DC converter is a device that receives ac electricity from an external power source and converts the AC electricity into DC electricity;

wherein the external power source is an externally provided source of AC electricity;

wherein the second battery is a rechargeable battery.

6. The safety device configured for use with the furnace according to claim 5 wherein the chemical energy stored within the second battery is renewed and restored through use of the AC/DC converter;

wherein the AC/DC converter is an electrical circuit that reverses the polarity of the second battery;

wherein the AC/DC converter provides the energy necessary to reverse a chemical processes that the second battery initially used to generate the electrical energy.

7. The safety device configured for use with the furnace according to claim 6 wherein the relay is further defined with a coil and a switch;

wherein the coil is an electromagnetic coil that generates a magnetic field that is used to open and close the switch of the relay;

wherein the closing of the switch will disable the furnace.

8. The safety device configured for use with the furnace according to claim 7 wherein the first logic module is selected from the group consisting of an electronic network assembled from discrete logic elements or a programmable electronic device;

wherein the second logic module is selected from the group consisting of an electronic network assembled from discrete logic elements or a programmable electronic device.

9. The safety device configured for use with the furnace according to claim wherein the first speaker and the second speaker are both buzzers.

10. The safety device configured for use with the furnace according to claim 6 wherein the first logic module is an electronic network assembled from discrete logic elements;

wherein the second logic module is an electronic network assembled from discrete logic elements;

wherein the first logic module makes a first decision to determine whether the CO2 sensor has detected a high concentration of carbon dioxide;

wherein the first logic module makes a second decision to determine whether the CO sensor has detected a high concentration of carbon monoxide;

wherein the first logic module takes a first action of sending the first message from the first communication module to the second communication module;

wherein the first logic module sends the first message through the first communication module to the second communication module of the second logic module;

wherein the first message is a message that is sent from the remote module to the furnace module indicating that the alarm condition has been detected;

wherein the first logic module takes a second action of illuminating the first diode and sounding the first speaker to announce the alarm condition;

wherein the first logic module takes a third action of sending the second message from the first communication module to the second communication module;

wherein the first logic module sends the second message through the first communication module to the second communication module of the second logic module;

wherein the second message is a message that is sent from the remote module to the furnace module indicating that the alarm condition is no longer being detected;

wherein the first logic module then takes a fourth action of extinguishing the first diode and silencing the first speaker;

wherein the second logic module makes a third decision to determine whether the second communication module has received the first message;

wherein if the second logic module determines that the first message has been received, then the second logic;

wherein the second logic module takes a fifth action energizing the relay coil in order to disable the furnace;

wherein the second logic module then takes a sixth action illuminating the second diode and sounding the second speaker to announce the alarm condition;

wherein the second logic module makes a fourth decision to determine whether the second communication module has received the second message.

11. The safety device configured for use with the furnace according to claim 6 wherein the first logic module is a programmable electronic device;

wherein the second logic module is a programmable electronic device;

wherein the first logic module makes a first decision to determine whether the CO2 sensor has detected a high concentration of carbon dioxide;

wherein the first logic module makes a second decision to determine whether the CO sensor has detected a high concentration of carbon monoxide;

wherein the first logic module takes a first action of sending the first message from the first communication module to the second communication module;

wherein the first logic module sends the first message through the first communication module to the second communication module of the second logic module;

wherein the first message is a message that is sent from the remote module to the furnace module indicating that the alarm condition has been detected;

wherein the first logic module takes a second action of illuminating the first diode and sounding the first speaker to announce the alarm condition;

wherein the first logic module takes a third action of sending the second message from the first communication module to the second communication module;

wherein the first logic module sends the second message through the first communication module to the second communication module of the second logic module;

wherein the second message is a message that is sent from the remote module to the furnace module indicating that the alarm condition is no longer being detected;

wherein the first logic module then takes a fourth action of extinguishing the first diode and silencing the first speaker;

wherein the second logic module makes a third decision to determine whether the second communication module has received the first message;

wherein if the second logic module determines that the first message has been received, then the second logic;

wherein the second logic module takes a fifth action energizing the relay coil in order to disable the furnace;

wherein the second logic module then takes a sixth action illuminating the second diode and sounding the second speaker to announce the alarm condition;

wherein the second logic module makes a fourth decision to determine whether the second communication module has received the second message.

12. The safety device configured for use with the furnace according to claim 11 wherein the first speaker and the second speaker are both buzzers.

* * * * *